US012558607B1

(12) United States Patent
Hoffmann

(10) Patent No.: US 12,558,607 B1
(45) Date of Patent: Feb. 24, 2026

(54) MOTORIZED BALANCING CHAIR AND FOOT STIRRUPS

(71) Applicant: Ethan Robert Hoffmann, Bentonville, AR (US)

(72) Inventor: Ethan Robert Hoffmann, Bentonville, AR (US)

( * ) Notice: Subject to any disclaimer, the term of this patent is extended or adjusted under 35 U.S.C. 154(b) by 305 days.

(21) Appl. No.: 18/497,592

(22) Filed: Oct. 30, 2023

(51) Int. Cl.
*A63C 17/28* (2006.01)
*A63C 17/12* (2006.01)

(52) U.S. Cl.
CPC ..... *A63C 17/28* (2013.01); *A63C 17/12* (2013.01)

(58) Field of Classification Search
CPC ..... A63C 17/28; A63C 17/12
See application file for complete search history.

(56) References Cited

U.S. PATENT DOCUMENTS

| | | | | |
|---|---|---|---|---|
| 9,101,817 | B2 | | 8/2015 | Doerksen |
| 9,283,848 | B2 | | 3/2016 | Parienti |
| 9,400,505 | B2 | | 7/2016 | Doerksen |
| 9,597,580 | B2 | | 3/2017 | Doerksen |
| 9,802,109 | B2 | | 10/2017 | Doerksen |
| D804,232 | S | * | 12/2017 | Oliphant ..... D6/716.1 |
| 9,968,841 | B2 | | 5/2018 | Doerksen |
| 9,988,114 | B1 | * | 6/2018 | Freakes ..... B62K 27/003 |
| 11,052,942 | B2 | | 7/2021 | Doerksen et al. |
| 11,123,629 | B1 | * | 9/2021 | Doerksen ..... B62K 11/007 |
| 11,273,364 | B1 | | 3/2022 | Doerksen et al. |
| 11,560,198 | B2 | | 1/2023 | Doerksen et al. |
| 11,590,409 | B2 | * | 2/2023 | Doerksen ..... B62K 1/00 |
| 2014/0326525 | A1 | * | 11/2014 | Doerksen ..... A63C 17/26 180/181 |
| 2024/0375743 | A1 | * | 11/2024 | Palmer ..... B62J 45/41 |

FOREIGN PATENT DOCUMENTS

| | | | | |
|---|---|---|---|---|
| CN | 202896778 U | * | 4/2013 | ..... B62K 5/02 |
| KR | 20130000605 U | * | 1/2013 | ..... A63C 17/26 |

OTHER PUBLICATIONS

KR-20130000605-U English Translation (Year: 2013).*
CN-202896778-U English Translation (Year: 2013).*

* cited by examiner

*Primary Examiner* — Michael T. Walsh
(74) *Attorney, Agent, or Firm* — Keisling & Pieper PLC; Trent C. Keisling; David B. Pieper

(57) ABSTRACT

A seated skateboard ride converter for a motorized central wheel skateboard with a driven wheel rotationally mounted to a support deck using a parallel-to-ground-plane foot dolly having a caster assembly supporting foot pegs on a foot peg frame connected by a substantially horizontal leg to a pitch and roll mid pivot connected to the motorized central wheel skateboard with a seat mounted above the driven wheel.

19 Claims, 13 Drawing Sheets

MOTORIZED BALANCING CHAIR AND FOOT STIRRUPS

CROSS-REFERENCE TO RELATED APPLICATIONS

Not Applicable.

FEDERALLY SPONSORED RESEARCH AND DEVELOPMENT

Not Applicable.

JOINT RESEARCH AGREEMENT

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

PRIOR ART

1. Field of the Invention

The present invention relates to improvements in riding motorized skateboards. More particularly, the invention relates to improvements particularly suited for providing a seated riding position on a pitch and roll controlled single central wheel skateboard. In particular, the present invention relates specifically to a seat mounted above a single wheel board with foot stabilization and pitch and roll capability.

2. Description of the Known Art

As will be appreciated by those skilled in the art, driven wheel systems are known in various forms. Patents disclosing information relevant to these driven wheel skateboards include: U.S. patent Ser. No. 11/590,409 82 issued to Doerksen on 2023 Feb. 28 entitled Self-stabilizing Skateboard; U.S. patent Ser. No. 11/273,364 B1 issued to Doerksen on 2022 Mar. 15 entitled Self-stabilizing Skateboard; U.S. Ser. No. 11/123,629 B1 issued to Doerksen on 2021 Sep. 21 entitled Suspension systems for an electric skateboard; U.S. Ser. No. 11/560,198 82 issued to Doerksen on 2023 Jan. 24 entitled Three-wheeled titling vehicle; U.S. Ser. No. 11/052,942 B2 issued to Doerksen on 2021 Jul. 6 entitled Three-wheeled titling vehicle; U.S. Pat. No. 9,968,841 82 issued to Doerksen on 2018 May 15 entitled Self-stabilizing Skateboard; U.S. Pat. No. 9,802,109 B2 issued to Doerksen on 2017 Oct. 31 entitled Self-stabilizing Skateboard; U.S. Pat. No. 9,597,580 B2 issued to Doerksen on 2017 Mar. 21 entitled Self-stabilizing Skateboard; U.S. Pat. No. 9,400,505 B2 issued to Doerksen on 2016 Jul. 26 entitled Self-stabilizing Skateboard; U.S. Pat. No. 9,283,848 B2 issued to Parenti on 2016 Mar. 5 entitled Foldable, Ultra-lightweight Tricycle Having An Electric Motor; and U.S. Pat. No. 9,101,817 issued to Doerksen on 2015 Aug. 11 entitled Self-stabilizing Skateboard. Folding chairs are also known in the art. For example, see US D804232 S, issued to Oliphant on 2017 Dec. 5 entitled Seat for a Folding Chair. Each of these patents is hereby expressly incorporated by reference in their entirety.

From these prior references it may be seen that these prior art patents are very limited in their teaching and utilization, and an improved seated skateboard is needed to overcome these limitations.

SUMMARY OF THE INVENTION

The present invention is directed to providing a seated skateboard riding position with foot stabilization while still providing pitch and roll control. In accordance with one exemplary embodiment of the present invention, a seated skateboard ride converter is provided for a motorized central wheel skateboard with a driven wheel rotationally mounted to a support deck. The seated skateboard ride converter uses a parallel-to-ground-plane foot dolly having a caster assembly supporting foot pegs on a foot peg frame. The foot peg frame is connected by a substantially horizontal leg to a pitch and roll mid pivot. The other side of the pitch and roll mid pivot is connected to the motorized central wheel skateboard and a seat is mounted above the driven wheel. In this manner, a seated position is provided for increased mobility, increased safety, and reduced operator fatigue These and other objects and advantages of the present invention, along with features of novelty appurtenant thereto, will appear or become apparent by reviewing the following detailed description of the invention.

BRIEF DESCRIPTION OF DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
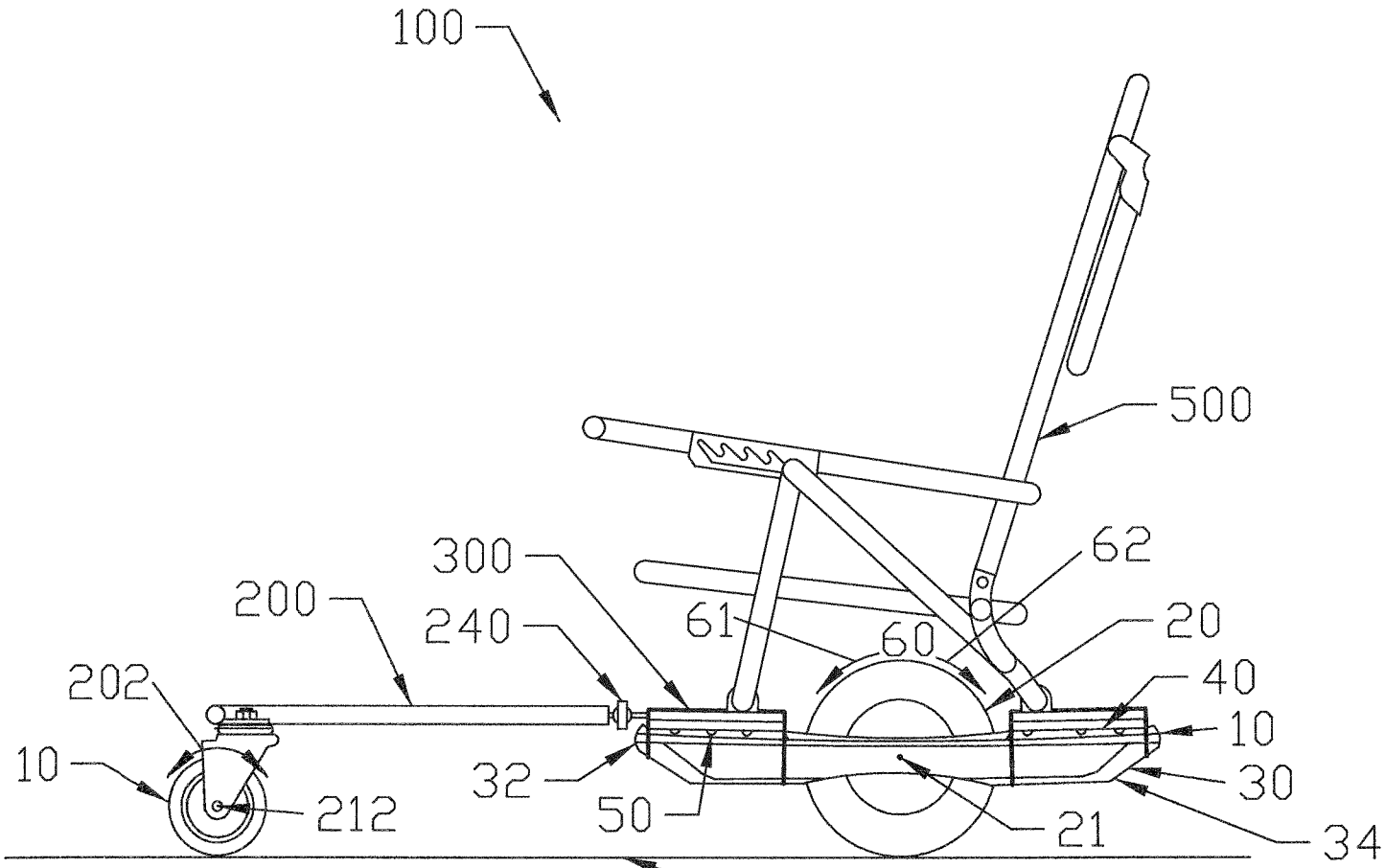
FIG. 1 is a side view of the Motorized Tricycle of the present invention
Figure 2:
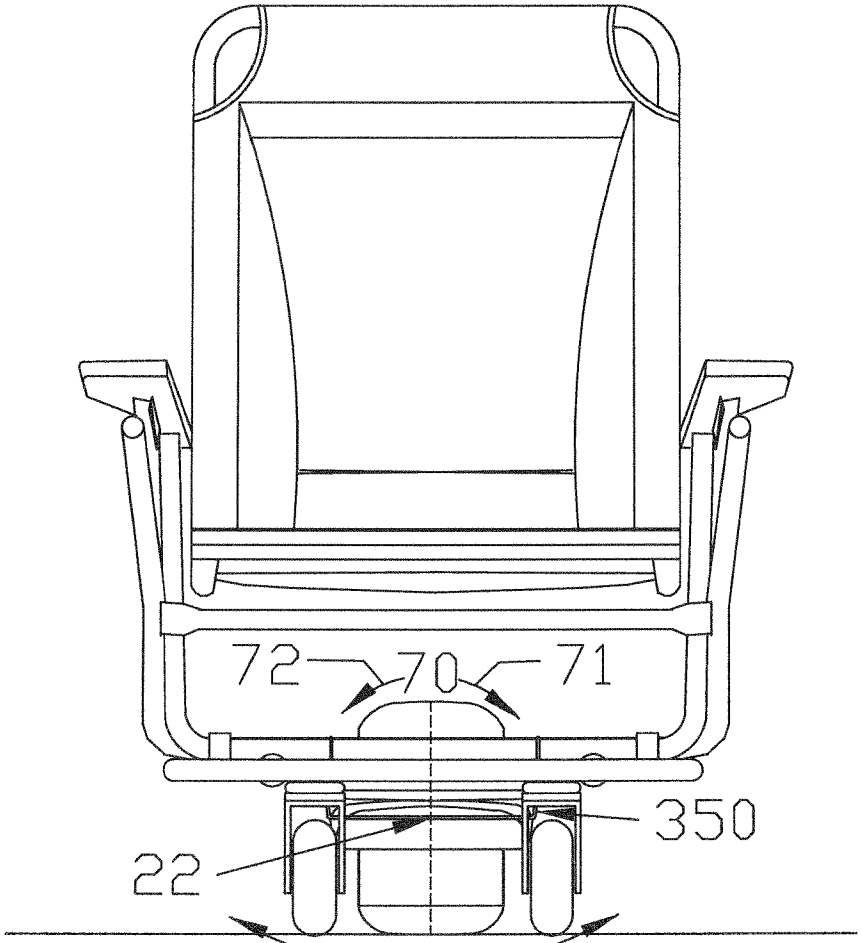
FIG. 2 is a front view thereof.
Figure 3:
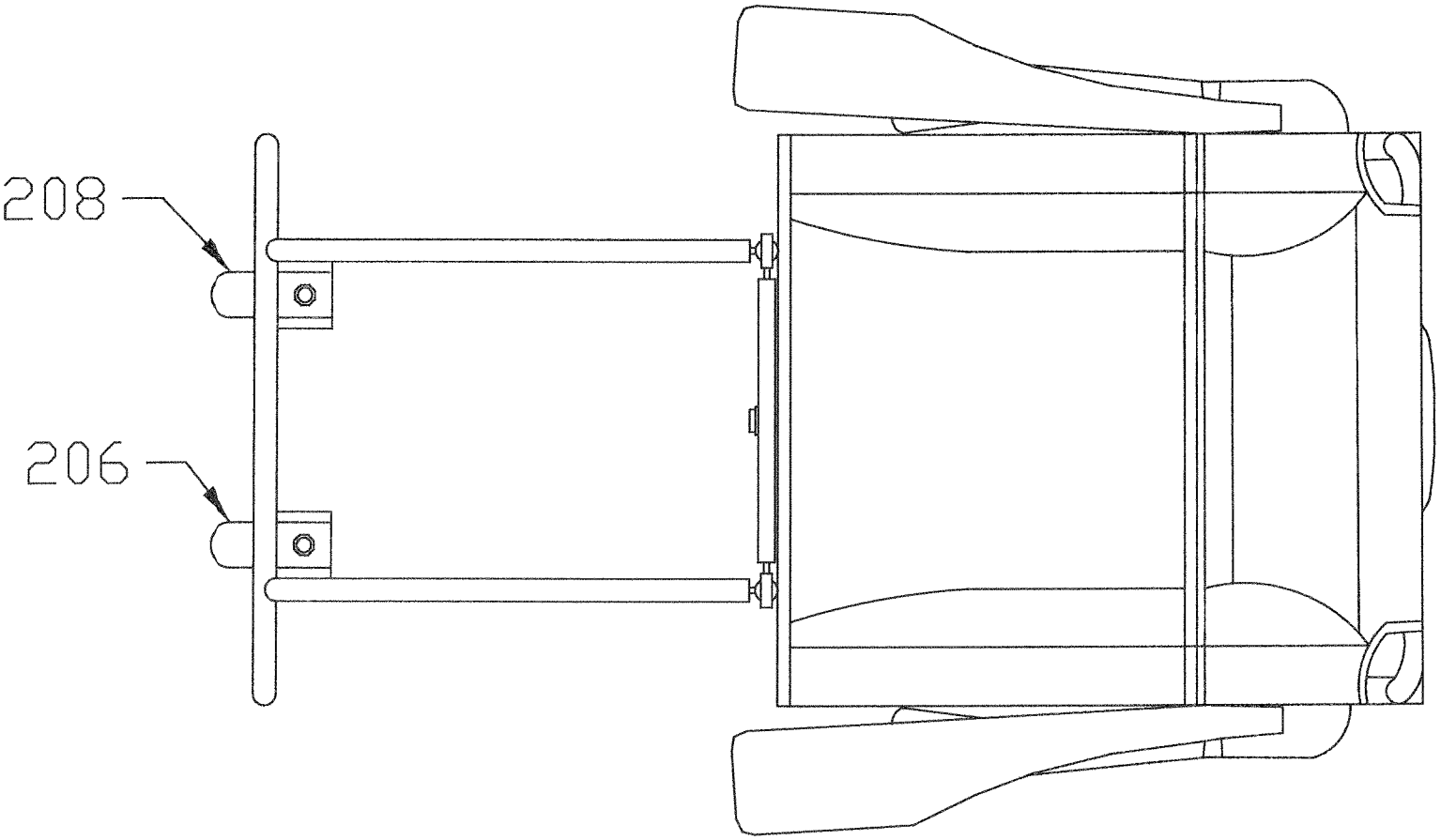
FIG. 3 is a top view thereof
Figure 4:
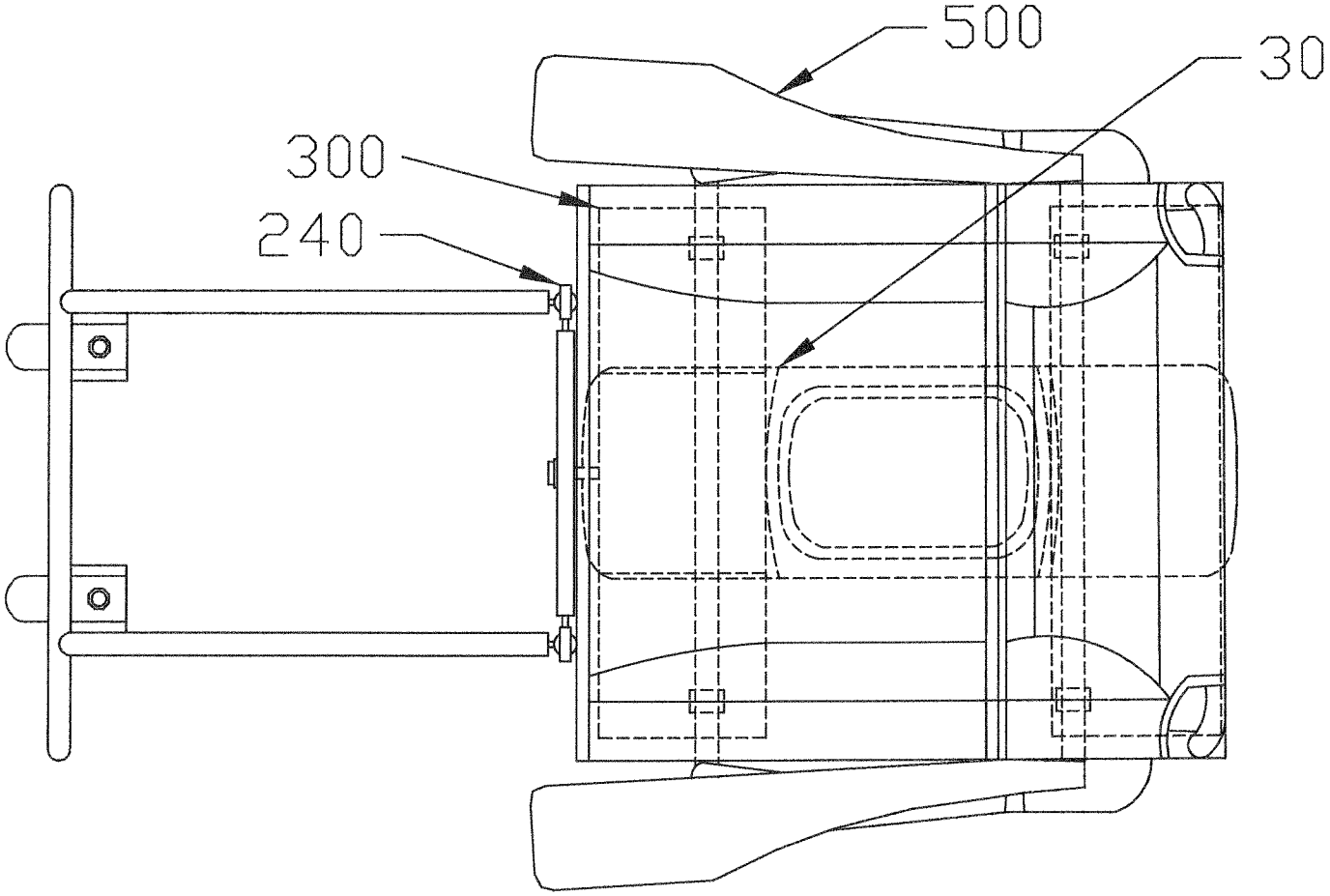
FIG. 4 is a top view thereof with dashed lines indicating component positioning below the seat.
Figures 5, 6, 7:
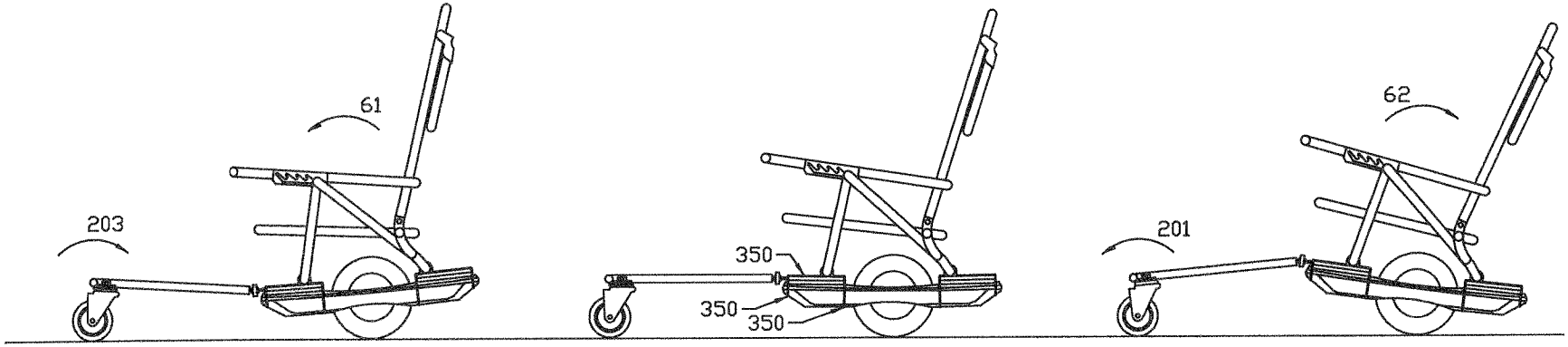
FIG. 5 is a side view thereof showing a front pitch.
FIG. 6 is a side view thereof showing a level pitch.
FIG. 7 is a side view thereof showing a back pitch.
Figures 8, 9, 10:
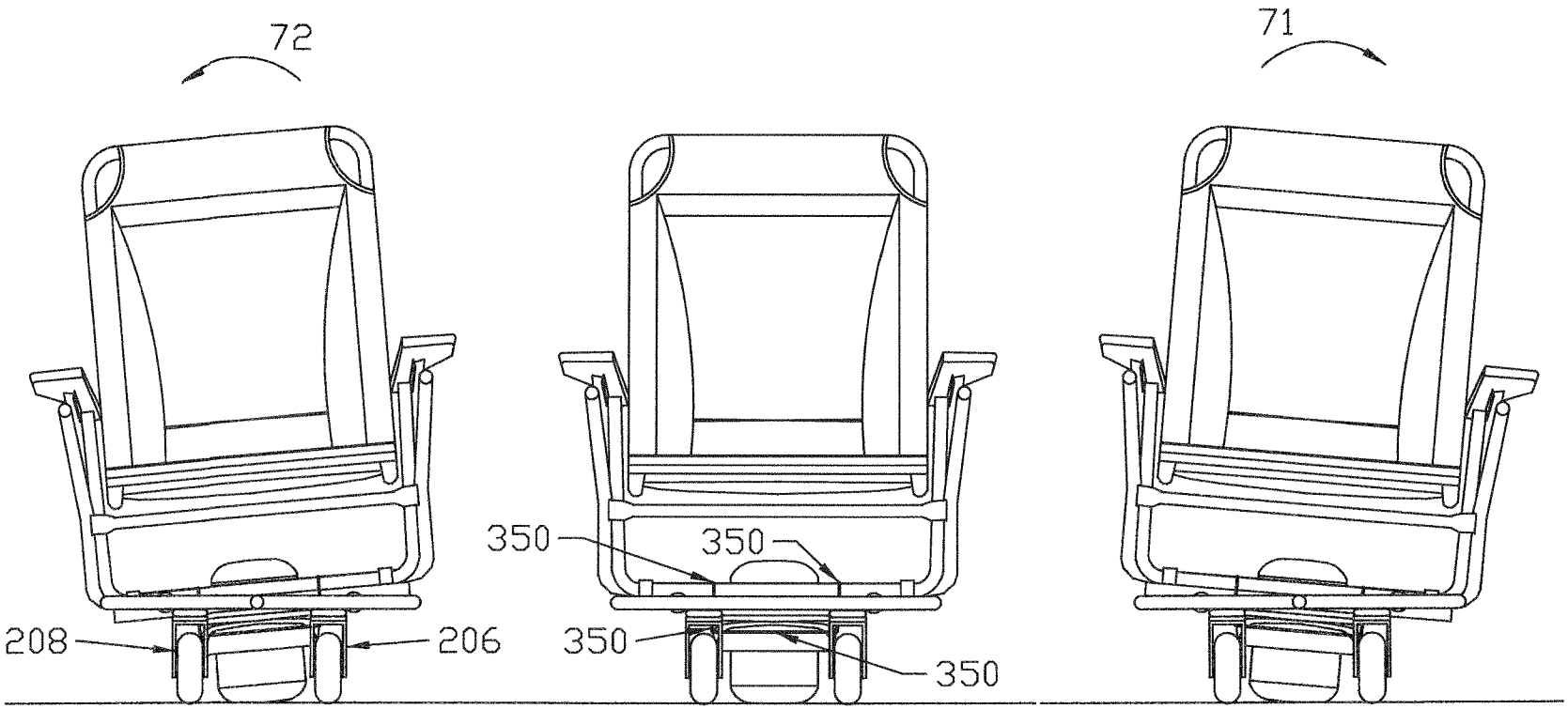
FIG. 8 is a side view thereof showing a right pitch.
FIG. 9 is a side view thereof showing a level pitch.
FIG. 10 is a side view thereof showing a left pitch.
Figure 11:
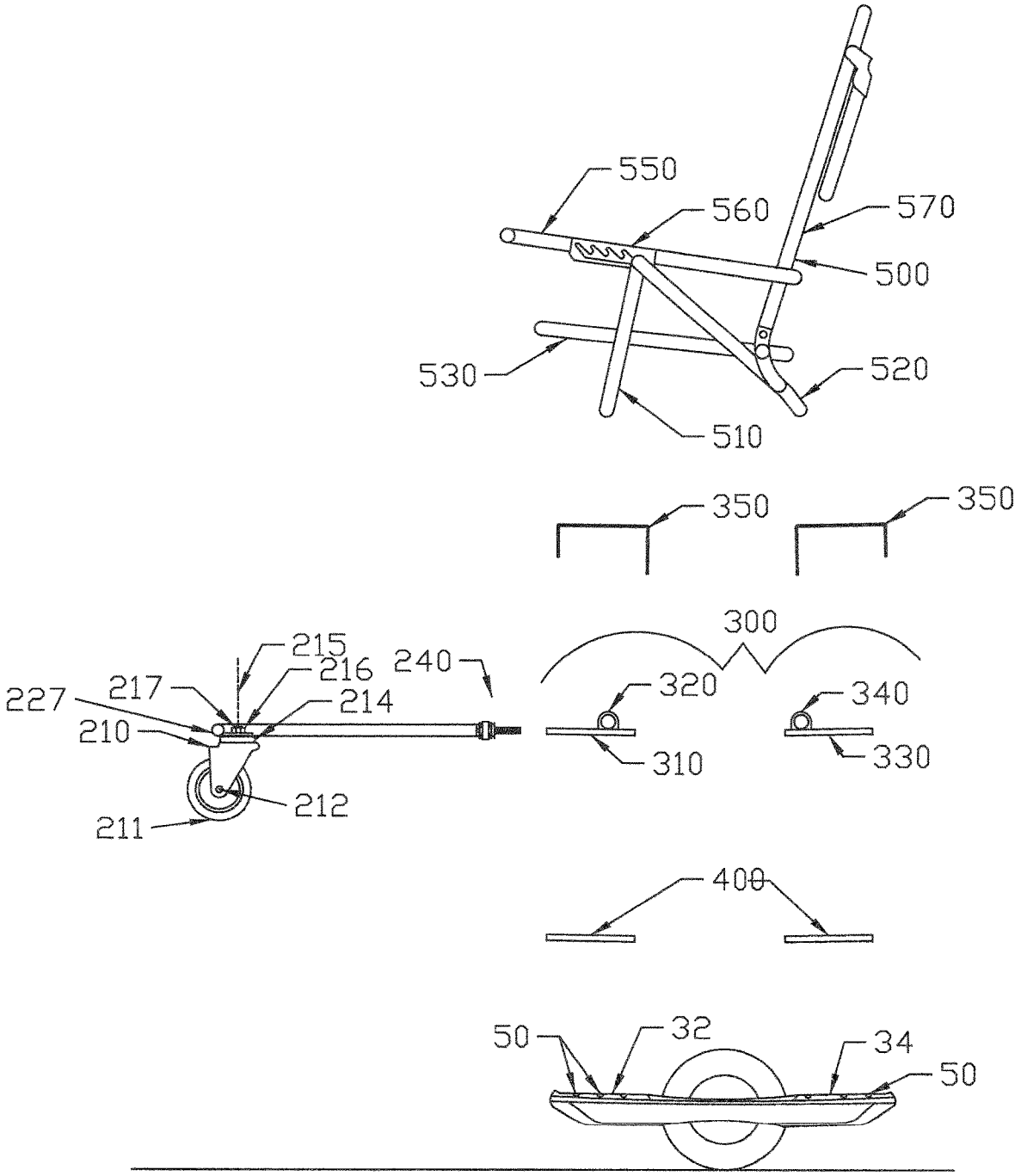
FIG. 11 is an exploded side view thereof.
Figure 12:
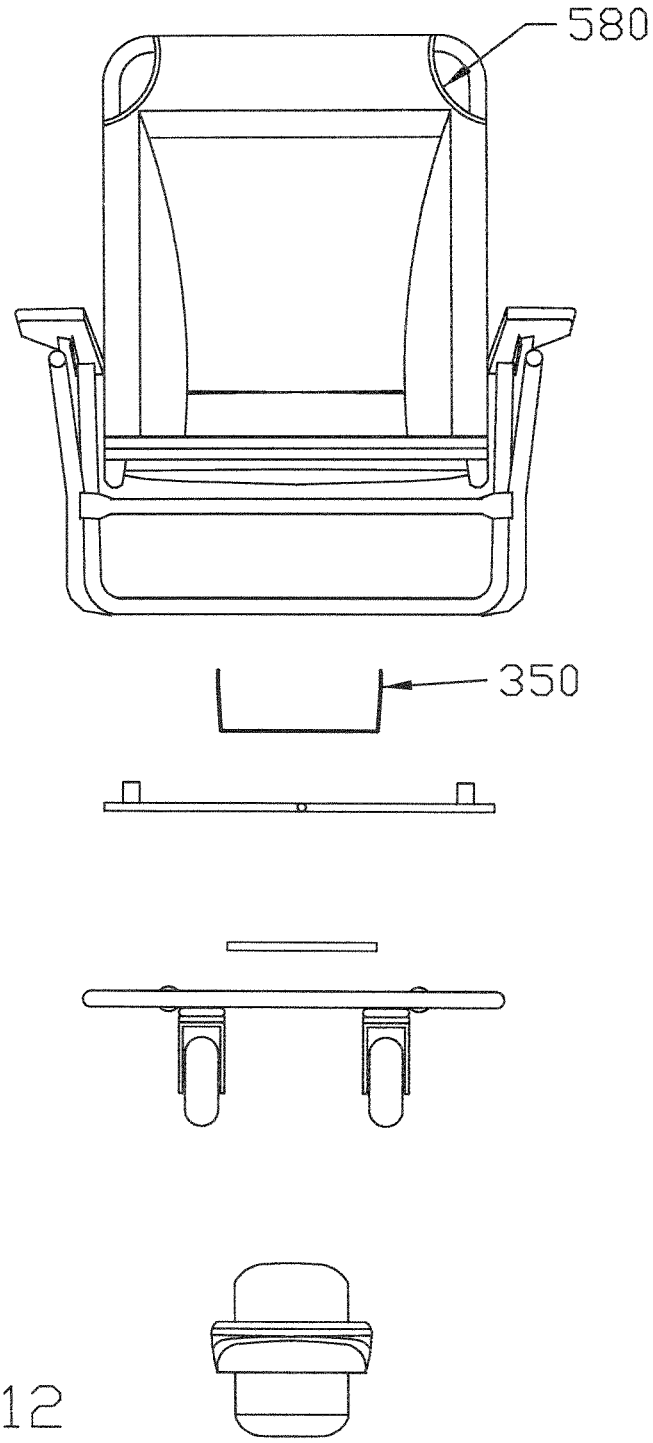
FIG. 12 is an exploded front view thereof.
Figure 13:
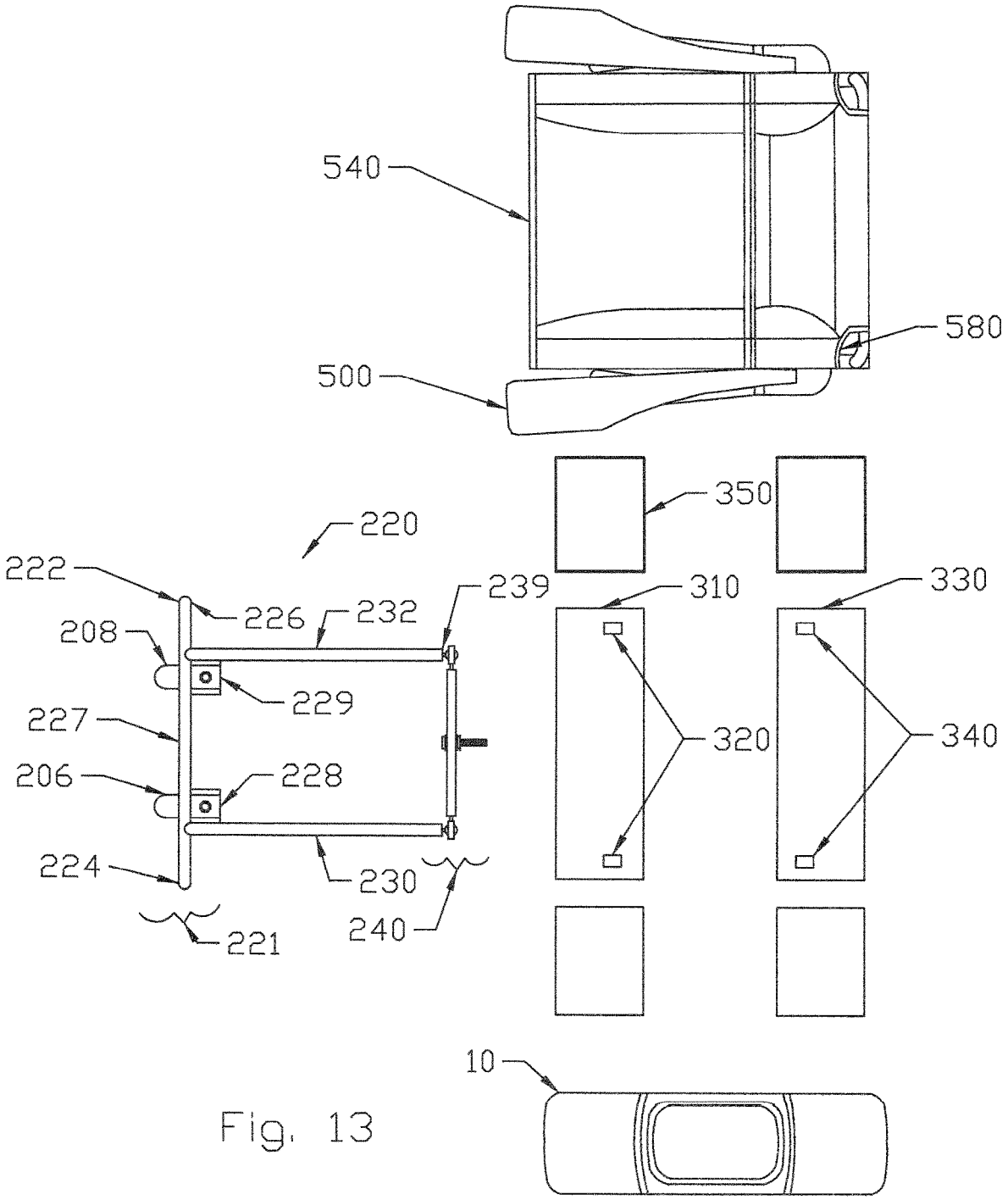
FIG. 13 is an exploded top view thereof.
Figure 14:
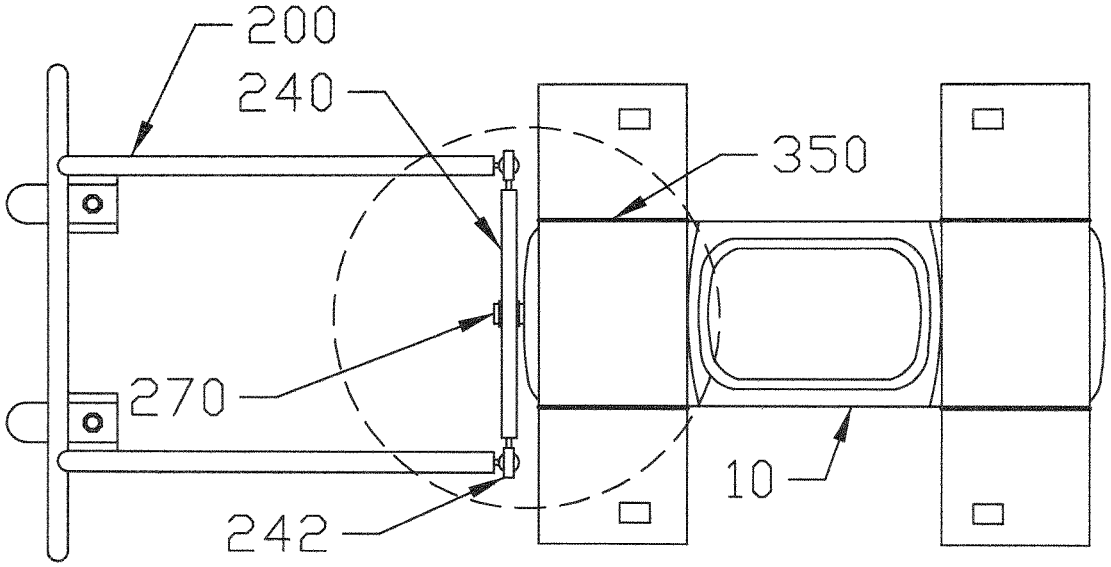
FIG. 14 is top view of the ground parallel foot dolly, and pitch and roll lateral clamp mounted on the pitch and roll single wheel skateboard.
Figure 15:
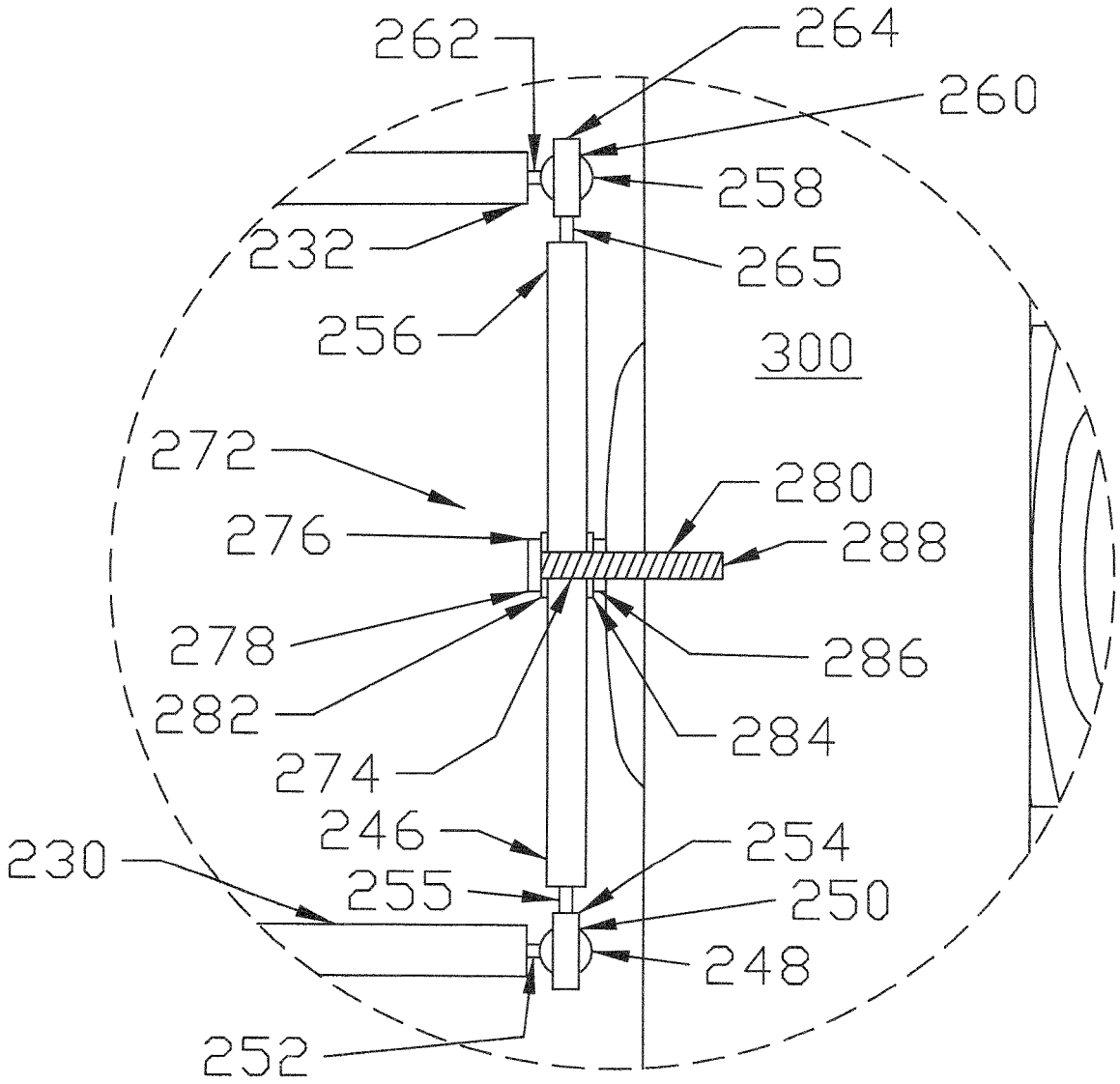
FIG. 15 is a magnified view of area 11-11 in FIG. 10.
Figure 16:
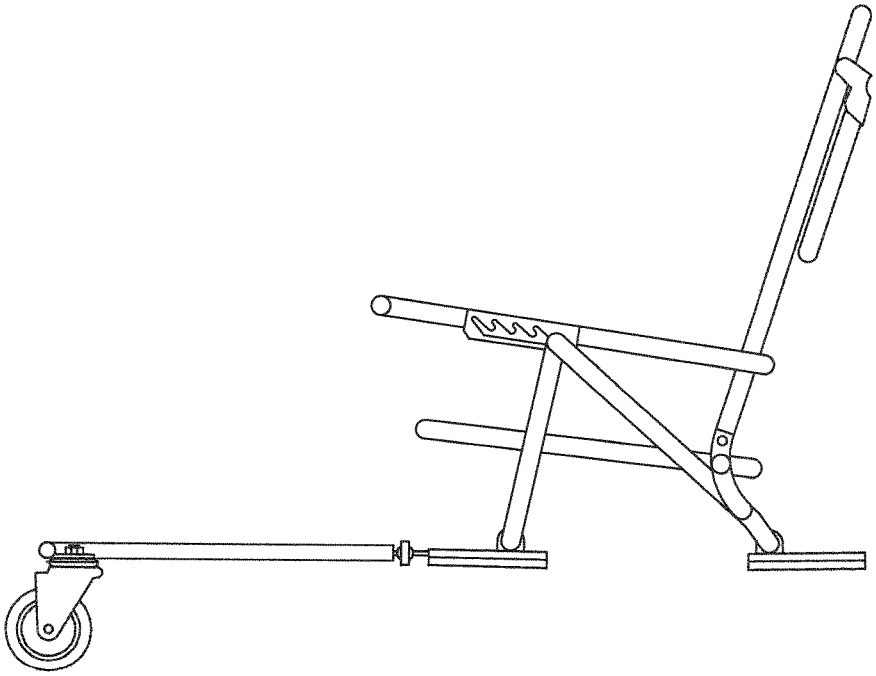
FIG. 16 is side view of the ground parallel foot dolly, and pitch and roll lateral clamp, and chair in an expanded position.
Figure 17:
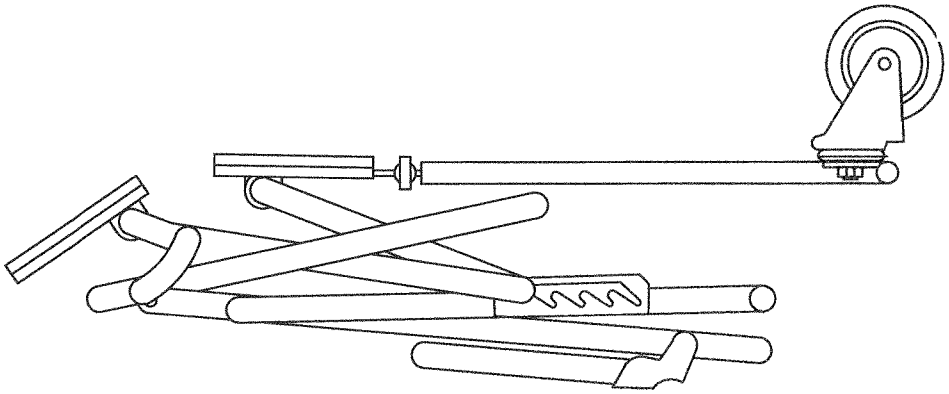
FIG. 17 is side view of the ground parallel foot dolly, and pitch and roll lateral clamp, and chair in a compacted position.

As shown in FIGS. 1 through 17 of the drawings, one exemplary embodiment of the present invention is generally shown as a skateboard ride converter 100 mounted on an electric pitch and roll central wheel skateboard 10 for riding across the ground plane 1. The central wheel skateboard 10 uses a battery, controller, and electric motor providing for a driven wheel 20 rotationally mounted in a support deck 30 with a top surface 40 including user sensors 50, a deck front 32, and deck back 34. These skateboards are fully detailed in the prior art previously discussed. The central wheel skateboard 10 is controlled by user movements creating board pitch 60 and board roll 70. Board pitch 60 includes both forward board pitch 61 and backwards board pitch 62 measured from the center axis 21 of the driven wheel 20. Board roll 70 includes both left board roll 71 and right board roll 72 measured from the vertical axis passing through the center line 22 of the driven wheel 20.

The skateboard ride converter 100 uses a ground plane foot dolly 200 connected through a mid pivot 240 to a pitch and roll lateral clamp 300 supporting a pitch and roll folding chair 500 off of the top surface 40 of the support deck 30.

The ground plane foot dolly 200 moves with variations in the ground plane 1 along a dolly pitch 202 and a dolly roll 204. Dolly pitch 202 includes front dolly pitch 201 and back dolly pitch 203 and dolly roll 204 includes front dolly roll 205 and back dolly roll 207. The dolly pitch 202 is measured at the horizontal rolling axle 212 of the caster assembly 10. Note that because the ground plane foot dolly 200 uses both a left caster assembly 206 and a right caster assembly 208, the dolly roll 204 follows and is always controlled by the ground plane 1 and is separate from the board roll 70.

The left caster assembly 206 and right caster assembly 208 both use a general caster assembly 210 including a caster wheel 211 mounted on a horizontal rolling axle 212 inside a full pivoting caster body 213. Each full pivoting caster body 213 vertically rotates using a caster bearing 214 rotating around a vertical caster pivot axis 215 and is secured by a caster securing nut 216 and caster mounting bolt 217 to the central web 227. The left caster assembly 206 is mounted at the left caster plate 228, and the right caster assembly 208 is mounted at the right caster plate 229.

The left caster assembly 206 and right caster assembly 208 support the foot end 221 of the foot peg frame 220 at the front cross body 222. The front cross body 222 includes a left foot peg 224 for the user's left foot and a right foot peg 226 for the user's right foot. In this way the user can push off of either or both sides of the foot peg frame 220 to control pitch and roll movements of the pitch and roll folding chair 500 that is clamped to and moves with the central wheel skateboard 10. Thus, the left foot peg 224 and right foot peg 226 are two contact points for control by the user along with a third contact point of the pitch and roll folding chair 500.

The front cross body 224 also includes a rigid central web 227 that is connected to the left caster plate 228, the right caster plate 229, the left side leg 230, and the right side leg 232. The left caster plate 228, the right caster plate 229 can be mounted between the left side leg 230 and the right side leg 232 or on the outside of the legs 230, 232, but the preferred design is shown here in the middle position. The left side leg 230 and the right side leg 232 extend the foot peg frame 220 to the pivot end 239 that is connected to the mid pivot 240.

The mid pivot 240 allows for pitch and roll differences between the ground plane foot dolly 200 and the central wheel skateboard 10. The mid pivot 240 includes a side to side pitch axis pivot 242 to allow for pitch differences and a Front to back roll axis pivot 270 to allow for roll differences. The mid pivot 240 can include a quick disconnect to allow for removal or separation of the ground plane foot dolly 200 from the chair 500. In this manner, the chair 500 on skateboard 10 can be ridden without the ground plane foot dolly 200, with the dolly 200 as a separate rolling item not connected to either the support deck 30 or the chair 500, or as shown herein with the ground plane foot dolly 200 connected to the support deck 30 and the chair 500.

The side to side pitch axis pivot 242 uses a back cross body 244 connected at a left heim end 246 to the left side leg 230 and a right heim end 256 to the right side leg 232.

The left heim end 246 uses a left heim ball 248 moveably mounted inside a left ball aperture 250. The left heim ball 248 is mounted to a left heim leg bolt 252 screwed into the left side leg 230. The left ball aperture 250 is defined by the left ball capturing body 254 mounted by the left body bolt 255 mounted into the left side 246 of the back cross body 244. Similarly, the right heim end 256 uses a right heim ball 258 moveable mounted inside a right ball aperture 260. The right heim ball 258 is mounted to the right heim leg bolt 262 screwed into the right side leg 232. The right ball aperture 260 is defined by the right ball capturing body 264 mounted via the right body bolt 265 screwed into the right side of the back cross body 244.

The front to back roll axis pivot 270 uses a central roll pivot 272. The central roll pivot 272 starts with a roll aperture 274 defined at the left to right center of the back cross body 244. A roll bolt 276 is rotationally mounted in the roll aperture 274. The roll bolt 276 uses a front clamp head 278 connected to a threaded extending shank 280 passing through a front clamp washer 282 to enter the roll aperture 274 and then exits with the threaded extending shank 280 passing through a back clamp washer 284 and secured by a back clamp nut 286. Note that the back clamp nut 286 is not tightened to stop the rotation allowing for roll movement differences. The threaded extending shank 280 ends at the lateral plate end 288 that is secured into the pitch and roll lateral clamp 300.

The pitch and roll lateral clamp 300 is connected to the mid pivot 240 and the support deck 30 and acts as a platform for the chair 500. The pitch and roll lateral clamp 300 includes a front cross support 310 and a back cross support 330. The front cross support 310 is secured to the support deck 30 in front of the driven wheel 20 at the deck front 32 and the back cross support 330 is secured to the deck back 34 using strap connectors 350 such as zip ties. The strap connectors 350 are releasable and go from a first end under the support deck 30 up the front, across the top, and down the back of each cross support (310 or 330) to connect a second end to the first end such that it connects to itself. While the zip tie is shown, any means of secure connection can be used here including adhesives, mechanical clamps, hook and loop straps, etc. Front leg clamps 320 connecting the front leg 510 are mounted on the front cross support 310 and the back cross support 330 has a set of back leg clamps 340 that clamp the back leg 520 of the chair 500. Both the front cross support 310 and the back cross support 330 are mounted using a pitch and roll clamp pad 400. The pitch and roll clamp pad 400 contact and activates the sensors 50 in the skateboard 10 to allow for proper operation of the skateboard 10.

The pitch and roll folding chair 500 can be of any type of seat for the user. It should be supportive, comfortable, and relatively light weight. It doesn't have to be a folding chair, although this provides a storage advantage. The present embodiment of the pitch and roll folding chair 500 includes a hinged front leg 510, hinged back leg 520, hinged seat frame 530 supporting a seat web 540, a hinged arm rest 550 including a back lean controlling position frame 560 and back frame 570 supporting a back web 580 to support a user. When the user sits on the seat web 540, their center of gravity is positioned above the driven wheel 20 to allow for leaning forward to induce forward pitch and leaning backwards to induce backward pitch of the skateboard 10. Similarly, leaning left induce a left roll and leaning right induces a right roll of the skateboard 10. Additionally, the user can lift up and lean on the armrests 500 for additional control. In this manner, a seated user can control the pitch and roll central wheel skateboard 10 from a seated position that has a lower center of gravity than a standing position such that greater mobility is provided.

Reference numerals used throughout the detailed description and the drawings correspond to the following elements:

- Pitch and roll central wheel skateboard 10
  - Driven wheel 20
  - Support deck 30
    - Top surface 40
    - User Sensors 50
  - Board pitch 60
  - Board roll 70
- Skateboard ride converter 100
- A ground plane foot dolly 200
  - front dolly pitch 201
  - dolly pitch 202
  - back dolly pitch 203
  - dolly roll 204
  - front dolly roll 205
  - a left caster assembly 206
  - back dolly roll 207
  - a right caster assembly 208
    - General Caster Assembly 210
      - Caster wheel 211
      - Horizontal rolling axle 212
      - Full pivoting caster body 213
      - Caster bearing 214
      - Vertical caster pivot axis 215
      - Caster Securing nut 216
      - Caster mounting bolt 217
  - Foot Peg frame 220
    - Foot end 221
    - Front Cross body 222
      - Left foot peg 224
      - Right foot peg 226
      - Central web 227
        - Left caster plate 228
        - Right caster plate 229
    - Left side leg 230
    - Right side leg 232
  - Pivot end 239
- Mid Pivot 240
  - Side to side pitch axis pivot 242
    - Back cross body 244
      - Left heim end 246
        - Left Heim ball 248
        - Left ball aperture 250
        - Left heim leg bolt 252
        - Left ball capturing body 254
        - Left body bolt 255
      - Right heim end 256
        - Right Heim ball 258
        - Right ball aperture 260
        - Right heim leg bolt 262
        - Right ball capturing body 264
        - Right body bolt 265
  - Front to back roll axis pivot 270
    - Central roll pivot 272
    - Roll aperture 274
    - Roll bolt 276
    - Front clamp head 278
    - Threaded extending shank 280
    - Front clamp washer 282
    - Back clamp washer 284
    - Back clamp nut 286
    - Lateral plate end 288
- Pitch and roll lateral clamp 300
  - Front cross support 310
    - Front leg clamps 320
  - Back cross support 330
    - Back leg clamps 340
  - Strap connector 350
- Pitch and roll clamp pads 400
- Pitch and roll folding chair 500
  - Front leg 510
  - Back leg 520
  - Seat frame 530
  - Seat web 540
  - Arm rest 550
    - Position frame 560
  - Back frame 570
  - Back web 580

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

The invention claimed is:

1. A skateboard ride converter for a motorized central wheel skateboard controlled by board pitch and board roll, the motorized central wheel skateboard including a driven wheel rotationally mounted to a support deck, the skateboard ride converter comprising:

a parallel-to-ground-plane foot dolly including a caster assembly mounted to a foot peg frame with left and right foot pegs and at least one leg;

a pitch and roll mid pivot including at least one pivot ball, the pitch and roll mid pivot connected between the parallel-to-ground-plane foot dolly and the motorized central wheel skateboard; and a seat mounted above the driven wheel.

2. The apparatus of claim 1, the foot peg frame further comprising:

a front cross body supporting the left foot peg and right foot peg.

3. The apparatus of claim 2, the front cross body further comprising:

a central web;

the at least one leg including a left side leg and a right side leg; and the central web connected to the left side leg and right side leg.

4. The apparatus of claim 3, the front cross body further comprising:

the central web connected to both a left caster plate and a right caster plate;

the left caster plate further connected to the left side leg; and the right caster plate connected to the right side leg.

5. The apparatus of claim 1, the pitch and roll mid pivot further comprising:

at least one heim end.

6. The apparatus of claim 1, the pitch and roll mid pivot further comprising:

a side to side pitch axis pivot.

7. The apparatus of claim 6, the side to side pitch axis pivot further comprising:

a back cross body.

8. The apparatus of claim 7, the side to side pitch axis pivot further comprising:

a left heim end connected to the parallel-to-ground-plane foot dolly; and a right heim end connected to the parallel-to-ground-plane foot dolly.

9. The apparatus of claim 1, the pitch and roll mid pivot further comprising:

a back cross body with a front to back roll axis pivot.

10. The apparatus of claim 9, the front to back roll axis pivot further comprising:

a central roll pivot.

11. The apparatus of claim 9, the central roll pivot further comprising:

the back cross body defining a roll aperture;

a roll bolt rotationally mounted in the roll aperture.

12. The apparatus of claim 11, further comprising:

a pitch and roll lateral clamp connecting the central roll pivot to the support deck.

13. The apparatus of claim 11, the pitch and roll lateral clamp further comprising:

a cross support connected to the support deck.

14. The apparatus of claim 13, further comprising:

the seat supported by a leg, and a leg clamp connecting the leg to the cross support.

15. The apparatus of claim 13, further comprising:

clamp pads mounted between the cross support and the support deck.

16. The apparatus of claim 11, the support deck including sensors, further comprising:

clamp pads mounted to the support deck, the clamp pads positioned on the sensors.

17. The apparatus of claim 1, the seat comprising:

a chair with a frame including a front leg positioned in front of the driven wheel and a back leg positioned behind the driven wheel.

18. The apparatus of claim 1, the seat comprising:

a seat frame supporting a seat web above the driven wheel.

19. The apparatus of claim 1, the seat comprising:

an arm rest connected to a front leg positioned in front of the driven wheel.

* * * * *